US005310467A

United States Patent [19]

Jacques

[11] Patent Number: 5,310,467

[45] Date of Patent: May 10, 1994

[54] CURRENT-CONDUCTING ROLLERS

[75] Inventor: Claude Jacques, Pontault Combault, France

[73] Assignee: Polimiroir, Saint-Soupplets, France

[21] Appl. No.: 960,580

[22] Filed: Oct. 13, 1992

[30] Foreign Application Priority Data

Oct. 15, 1991 [FR] France ..... 91 12678

[51] Int. Cl.[5] ..... C25D 17/00

[52] U.S. Cl. ..... 204/279

[58] Field of Search ..... 204/280, 286, 289, 199, 204/212, 229, 279

[56] References Cited

U.S. PATENT DOCUMENTS 5,083,353 1/1992 Jacques ..... 204/280

FOREIGN PATENT DOCUMENTS 2018741 12/1990 Canada ..... 204/280

*Primary Examiner*—Donald R. Valentine
*Assistant Examiner*—Patrick J. Igoe
*Attorney, Agent, or Firm*—McCormick Paulding & Huber

[57] ABSTRACT

The present invention provides a current-conducting roller comprising a central portion constituting the main axial portion of the roller and two half-shafts extending respective ends of the central portion, each half-shaft comprising a steel body provided with an internal copper heat-shrink fitting itself provided with an internal protective bushing, wherein the internal copper fitting is placed in a blind bore of the steel body and wherein it is provided with a compressible gasket interposed between the end of the blind bore and the corresponding end of the internal copper fitting.

27 Claims, 2 Drawing Sheets

CURRENT-CONDUCTING ROLLERS

The present invention relates to the field of current-conducting rollers, particularly but not exclusively rollers for DC electrolysis lines.

BACKGROUND OF THE INVENTION

An object of the present invention is to improve the current-conducting rollers described in Document FR-A-2 648 269.

Accompanying FIG. 1 shows a portion of a current-conducting roller of the type described in said Document FR-A-2 648 269. Accompanying FIG. 1 corresponds to FIG. 3 of Document FR-A-2 648 269.

The rollers 100 described in Document FR-A-2 648 269 comprise a central portion 110 that can be seen in part in accompanying FIG. 1. This central portion 110 is circularly cylindrical about the axis 102 of the roller. It constitutes the main active portion of the roller during electrolysis. This central portion 110 is generally called the "barrel" of the roller.

Each axial end of this central portion 110 is extended by a corresponding half-shaft 120 centered on the axis 102. The Document FR-A-2 648 269 relates essentially to the structure of these half-shafts 120.

The diameter of the half-shafts 120 is less than the diameter of the central portion 110. They have two essential functions: firstly that of guiding the roller 100 in rotation about the axis 102; and secondly that of feeding current to the roller 100.

It may be observed that the rollers 100 have an axial channel 130 passing therethrough to convey a flow of cooling water.

The roller needs to be cooled most particularly in the current collection zones formed by the half-shafts 120.

More precisely, according to Document FR-A-2 648 269 each of the half-shafts 120 comprises a steel body 140 that is a body of revolution about the axis 102. The axially inner end of the body 140 is welded at 142 to a steel sleeve 110 centered on the axis 102 and forming the central portion 110 of the roller.

The body 140 is also welded at its axially outer end to an added-on endpiece 180.

According to Document FR-A-2 648 269, the steel body 140 is provided with an internal copper heat-shrink fitting 150 in order to enable it to pass the required amperage.

The internal copper fitting 150 is itself protected by a bushing 160 that is complementary to the inside surface of the copper fitting 150. The bushing 160 is preferably made of stainless steel. Each internal copper fitting 150 is further protected by two washers 162 and 164 extending transversely relative to the axis 102. The washers 162 and 164 cover respective axial ends of the fittings 150. Their inside peripheries are welded to the bushing 160 and their outside peripheries are welded to the steel body 140.

The bushing 160 in combination with the washers 162 and 164 prevent the internal copper fittings 150 from corroding.

As mentioned above, an object of the present invention is to improve the conducting rollers described in Document FR-A-2 648 269 and as shown in accompanying FIG. 1.

An important object of the present invention is to adapt the current-conducting roller to use with water manifolds.

Another important object of the present invention is to reinforce the strength of current-conducting rollers.

SUMMARY OF THE INVENTION

According to the present invention, the current-conducting roller comprises a central portion constituting the main axial portion of the roller and two half-shafts extending respective ends of the central portion, each half-shaft comprising a steel body provided with an internal copper heat-shrink fitting itself provided with an internal protective bushing, wherein the internal copper fitting is placed in a blind bore of the steel body and wherein it is provided with a compressible gasket interposed between the end of the blind bore and the corresponding end of the internal copper fitting.

Advantageously, the compressible gasket is suitable for expanding radially when subjected to axial compression.

Also advantageously, the steel body is provided with at least one generally radial through duct located axially outside the copper fitting.

According to another advantageous feature of the invention, the steel body of each half-shaft is made as a single piece.

BRIEF DESCRIPTION OF THE DRAWINGS

Embodiments of the invention are described by way of example with reference to the accompanying drawings, in which.

DETAILED DESCRIPTION

Figure 2:
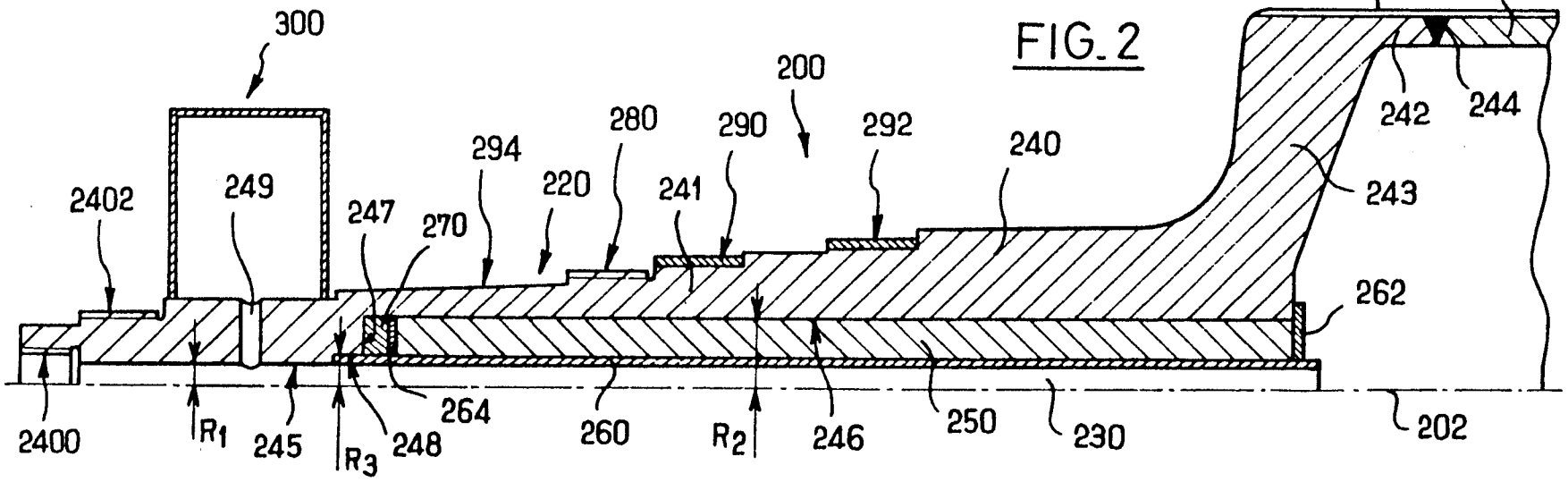
FIG. 2 is a fragmentary diagrammatic axial section through a current-conducting roller of the present invention.

Accompanying FIG. 2 shows a current-conducting roller 200 comprising a central portion 210 extended at each end by a respective half-shaft 220.

The central portion 210 of the roller is constituted by a steel sleeve 212 that is circularly cylindrical about the axis 202. Where appropriate, the central portion 210 may be provided with a coating 214, e.g. a copper coating deposited by electroplating. However the coating 214 is not essential.

FIG. 2 shows a portion of a single half-shaft 220.

The second half-shaft provided at the opposite end of the central portion 210 may be symmetrical to that shown in FIG. 2.

As shown in accompanying FIG. 2, each half-shaft 220 preferably comprises: a steel body 240; an internal copper heat-shrink fitting 250; a protective bushing 260; two washers 262 and 264; and a compressible gasket 270.

The steel body 240 is centered on the axis 202 of the roller. The steel body 240 may be implemented in numerous different ways. Its section is preferably stepped lengthwise. The stepped section of the steel body 240 increases in size on going from the axial end of the half-shaft 220 towards the central portion 210.

The steel body 240 comprises an axially outer portion 241, an axially inner portion 242, and a transition zone 243. The axially outer portion 241 comprises a succession of cylindrical portions centered on the axis 202 and of increasing section going towards the central portion 210. The axially inner portion 242 is greater in diameter than the axially outer portion 241. The outside radius of the axially inner portion 242 is equal to the outside radius of the sleeve 212. The axially inner portion 242 is welded to the sleeve 212 of the central portion by means of an annular weld fillet 244.

The transition zone 243 diverges from the axis 202 on getting closer to the axially inner portion 242.

Where appropriate, the axially inner portion 242 may also be covered by the coating 214.

The steel body 240, and more precisely the axially outer portion 241 thereof, is provided with a through axial bore 245 of radius R1.

This bore 245 in combination with the bushing 260 forms a through axial passage 230 in a manner described in greater detail below.

The axially outer portion 241 of the steel body 240 is also provided with a blind second bore 246 of radius R2 greater than the radius R1 of the above-mentioned through bore 245.

The blind second bore 246 opens out to the axially inner end of the axially outer portion 241 of the steel body 240. This second bore 246 extends over the major portion of the length of the portion 241 of the steel body 240, and typically it extends over 75% of the length of said portion 241.

In other words, the end 247 of the blind bore 246 faces the inside of the roller. That is why the bore 246 must be formed in the steel body 240 before it is welded to the central sleeve 212.

The axial bore 246 is designed to receive the internal copper heat-shrink fitting 250 as described in Document FR-A-2 648 269.

That is why the outside radius of the internal copper fitting 250 matches the radius R2 of the bore 246.

The bushing 260 is preferably made of stainless steel.

The bushing 260 is preferably assembled to the inside of the copper fitting 250 by a heat-shrink technique.

The bushing 260 is intended to protect the copper fitting 250 from the cooling water flowing along the central channel 230 of the roller and from the chromic acid that is used, where appropriate, for reconditioning the roller.

To do this, the stainless steel bushing 260 is longer than the copper fitting 250 and it projects axially from each of the ends thereof.

As shown in FIG. 2, a third axial bore 248 is preferably provided in the steel body 240, the third bore having a radius R3 intermediate between the radius R1 of the through bore 245 and the radius R2 of the blind bore 246. The radius R3 of this third axial bore 248 is substantially complementary to the outside radius of the stainless steel bushing 260. In addition, the bushing 260 has an inside radius equal to the radius R1 of the bore 245. The bushing 260 thus does not project into the axial passage 230 and therefore does not disturb the flow of cooling water.

The washer 262 and the washer 264 are preferably made of stainless steel.

The washer 262 is placed on the axially inner end of the copper fitting 250. To protect this fitting effectively, the radially outer periphery of the washer 262 is fixed to the steel body 240 and the radially inner periphery thereof is fixed to the stainless steel bushing 260.

The washer 264 is placed on the axially outer end of the internal copper fitting 250. Its radially inner periphery is preferably welded on the stainless steel bushing 260.

However, the outside radius of the washer 264 is preferably less than the radius R2 of the blind bore 246.

The purpose of this disposition is to enable the internal copper fitting 250 and the washer 264 to be assembled inside the blind bore 246 while guaranteeing close contact between the outside wall of the internal heat-shrink fitting 250 and the inside wall of the steel body 240 as constituted by the blind bore 246, and in spite of the difference between the expansion coefficients of the copper used for the fitting 250 and of the stainless steel constituting the washer 264.

To guarantee good sealing at the axially outer end of the internal copper fitting 250 in spite of the washer 264 being smaller in section that the bore 246, as mentioned above, the invention provides for a compressible gasket 270 being fitted between the end 247 of the bore 246 and the washer 264.

The gasket 270 is preferably a gasket designed to be subject to radial expansion when it is subjected to axial compression.

The gasket 270 is adapted to the geometry of the bottom 247 of the bore 246.

It is preferably a silicone gasket with lips.

Figure 3:
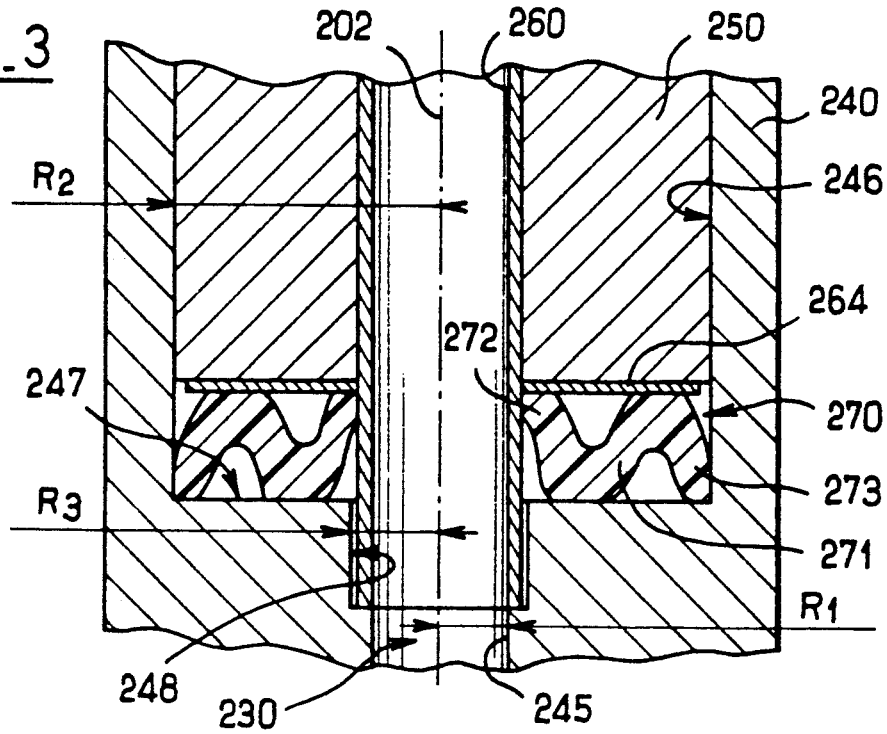
FIGS. 3 and 4 are fragmentary longitudinal axial section views showing two variant embodiments of a compressible gasket in accordance with the present invention.

FIG. 3 shows a first embodiment of a gasket 270 adapted to an end 247 of the bore which is flat and orthogonal to the axis 101.

The gasket 270 shown in FIG. 3 essentially comprises a ring 271 having a first lip 272 directed generally radially inwards and axially towards the inside of the roller, and having a second lip 273 directed generally radially outwards and axially towards the outside of the roller.

The person skilled in the art will readily understand that when axial compression is exerted on the gasket 270 it is subject to radial expansion. The first lip 272 tends to be pressed against the outside surface of the stainless steel bushing 260 and against the axially outer surface of the washer 264. Symmetrically, the second lip 273 tends to be pressed against the inside surface of the bore 246 and against the end 247 thereof.

Figure 4:
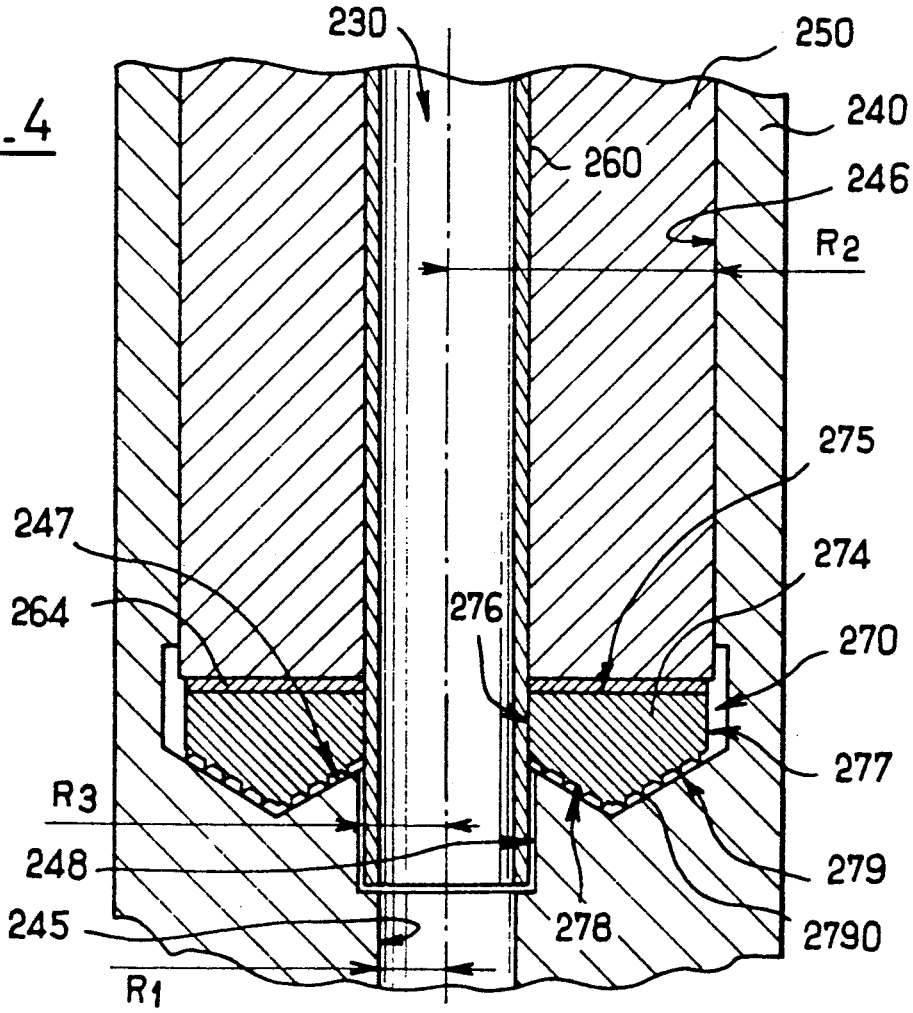

FIG. 4 shows a second variant embodiment of a compressible gasket 270 adapted to an end 247 of the bore constituted by a groove having a V-shaped section.

The gasket 270 shown in FIG. 4 comprises an annular block 247 having an axially inner face 275 which is plane and rests against the axially outer surface of the washer 264. The annular block 274 has a radially inner surface 276 that is circularly cylindrical about the axis 202 and is generally complementary to the outside surface of the bushing 260. The annular block 274 has a radially outer surface 277 of smaller radius than the bore 246. Finally, the annular block 274 is delimited by two axially outer facettes 278 and 279 that slope relative to the axis 202 so as to be generally parallel to the facettes defining the end groove 247 of the bore 246. The facettes 278 and 279 are provided with pluralities of annular lips 2790 designed to rest against the corresponding facettes of the end 247 of the bore 246.

Naturally numerous other variant implementations may be envisaged for the gasket 270.

To assemble the current-conducting roller as described above, the procedure is essentially as follows.

The stainless steel bushing 260 is shrink-fitted inside the internal copper fitting 250 (by heating the fitting 250 and by cooling the bushing 260). The stainless steel washer 264 is engaged on the axially outer end of the bushing 260 and is welded thereto.

The inner copper fitting 250 is then shrink-fitted inside the bore 246 of the steel body 240 (by heating the body 240 and cooling the fitting 250). Because of its smaller size, the washer 264 does not disturb this heat-shrink assembly in spite of the difference between the thermal expansion coefficient of stainless steel and that of copper, and in spite of the close complementary fit provided between the internal copper fitting 250 and the bore 246 (the outside surface of the fitting 250 and the inside surface of the bore 246 both have accurately rectilinear director lines of considerable length).

At the end of engaging the internal copper fitting 250, the gasket 270 is subjected to axial compression, thereby causing said gasket to expand radially in such a manner as to guarantee good sealing against the axially outer end of the internal copper fitting 250.

The stainless steel washer 262 can then be placed on the axially inner end of the bushing 260 and can be welded thereto and also to the steel body 240.

Figure 1:
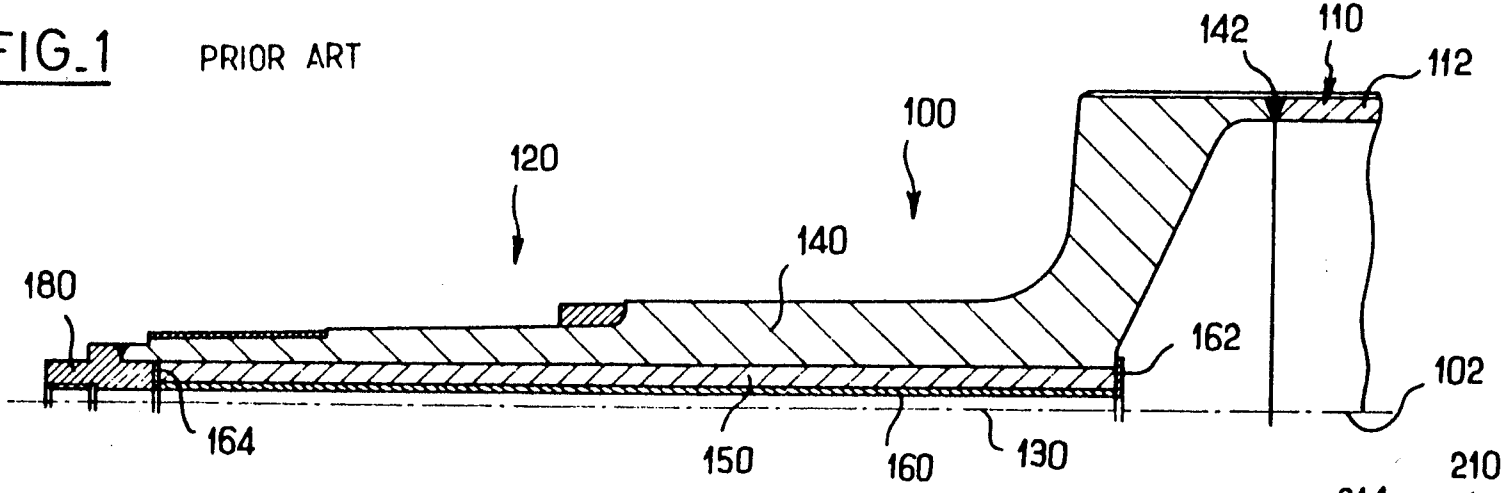
FIG. 1 PRIOR ART
FIG. 1, described above, is a fragmentary diagrammatic view in axial section through a current-conducting roller as described in Document FR-A-2 648 269.

It may be observed that according to the invention, the steel body 240 is a single piece. It does not have an end fitting similar to the end fitting 180 mentioned above with reference to FIG. 1. The mechanical strength of the roller 200 is thus increased. It can withstand large twisting forces, in particular when rotation is stopped suddenly.

According to the invention, at least one of the two half-shafts 220 is provided with at least one through duct 249 located axially outside the internal copper fitting 250 and extending in a direction that is generally radial relative to the axis 202. This duct is designed to open out into a manifold for collecting the cooling water flowing along the central passage 230 of the roller. Such a manifold is outlined in FIG. 2 and is referenced 300. It may be implemented in numerous different ways known to the person skilled in the art and is therefore not described in greater detail below. Each half-shaft 220 preferably possesses at least two radial ducts 249 both opening out into the manifold 300.

The use of such a manifold 300 makes it possible to release the axially outer end of the half-shaft 220, e.g. to enable it to be fitted with rotary drive means.

More precisely, and preferably, radial ducts 249 are provided through one of the two half-shafts 220, namely that one of the half-shafts which is fitted with rotary drive means.

Under such circumstances, the cooling fluid is injected axially via the central passage 230 in one of the half-shafts, and escapes into the manifold 300 via the radial ducts 249 in the other half-shaft.

According to an advantageous characteristic of the invention, in order to improve electrical contact, provision is also made to have a layer of silver plating between the steel body 240 and the internal copper fitting 250.

The silver plating may be formed either on the inside surface of the bore 246 or else on the outside surface of the fitting 250.

The outside surface of the half-shaft 240 is preferably chromium plated.

As shown diagrammatically in accompanying FIG. 2, the outside surface of the steel body 240 may be provided with bearing forces 290 and 292 for gaskets associated with a ball bearing placed between these bearing surfaces. The outside surface of the steel body 240 may also be provided with a thread 280 for receiving a nut that clamps onto said ball bearing. The bearing surfaces 290 and 292 may be made of chromium, for example, or by means of a stainless steel ring, or by means of a stainless steel ring coated in chromium oxide.

The threads 280 may be formed directly in the steel body 240.

The axial end of the steel body 240 is adapted in conventional manner to receive rotary drive means. By way of non-limiting example, the end of the steel body 240 may h=provided with tapping 2400 in the bore 245, and with an outside thread 2402.

The tapping 2400 is intended to receive a sealing plug.

The thread 2402 is intended to receive a nut for clamping the manifold and the drive means.

A current collector bearing surface 294 may be formed between the thread 280 and the manifold. This current collector bearing surface 294 may be formed by silver plating or by copper plating, e.g. plated by electrolysis.

Naturally, the present invention is not limited to the particular embodiment described above but extends to any variant coming within the ambit thereof.

I claim:

1. A current-conducting roller comprising:

a central sleeve constituting the main axial portion of the roller, two steel bodies extending on respective ends of the central sleeve, and each provided with a through axial bore, a blind second bore opening out to the axially inner end of the steel body and having a radius greater than the radius of said through axial bore, a blind third bore opening out to the axially inner end of the steel body and having a radius intermediate between the radius of the through bore and the radius of the blind second bore, an internal copper heat-shrink fitting received in said blind second bore of each steel body, the outside radius of the internal copper fitting matching the radius of said blind second bore, an internal protective bushing provided inside each fitting, said bushing being longer than the copper fitting and projecting axially from each of the ends thereof, said internal bushing being received in said blind third bore of each steel body, the outside radius of said bushing being substantially complementary to the radius of said blind third bore and having an inside radius equal to the radius of the through axial bore, so that said bushing does not project into said through bore, a first metal washer placed on the axially inner end of each copper fitting, said first washer having a radially outer periphery and a radially inner periphery, the radially outer periphery of said first washer being fixed to a respective steel body and the radially inner periphery being fixed to the bushing, a second metal washer placed on the axially outer end of each copper fitting, said second washer having a radially outer periphery and a radially inner periphery, the radially inner periphery of said second washer being welded on a respective bushing, while the radius of the outside periphery of said second washer being less than the radius of said blind second bore, a compressible gasket interposed between the end of each blind second bore and the corresponding second metal washer, said compressible gasket being suitable for expanding radially when subject to axial compression so as to guarantee good sealing against the axially outer end of the internal fitting, at least one through duct located axially outside the internal copper fitting of one of said two steel bodies and extending in a direction that is generally radial relative to a central axis o said roller, and a manifold provided outside said one steel body, in which opens said through duct, so as to collect cooling water flowing along said through axial bore of the roller.

2. A current-conducting roller according to claim 1, wherein the compressible gasket is made of silicone.

3. A current-conducting roller according to claim 1, wherein the compressible gasket is formed by a base ring carrying at least one annular lip.

4. A current-conducting roller according to claim 1, wherein the compressible gasket comprises a base ring provided with a first lip directed generally radially inwards and axially towards the inside of the roller, and with a second lip directed generally radially outwards and axially towards the outside of the roller.

5. A current-conducting roller according to claim 1, wherein the compressible gasket comprises a base ring which is generally complementary in shape to the bottom of the blind bore and which carries annular sealing lips.

6. A current-conducting roller according to claim 1, wherein only one of the steel bodies is provided with generally radial through ducts.

7. A current-conducting roller according to claim 1, wherein each steel body is made as a single piece.

8. A current-conducting roller according to claim 1, wherein the internal protective bushing is made of stainless steel.

9. A current-conducting roller according to claim 1, wherein the second metal washer is made of stainless steel.

10. A current-conducting roller according to claim 1, wherein a layer of silver plating is provided between the steel body and the internal copper fitting.

11. A current-conducting roller according to claim 1, wherein the bushing is assembled to the inside of the copper fitting by a heat-shrink technique.

12. A current-conducting roller comprising:

a central sleeve constituting a main axial portion of the roller, two steel bodies extending on respective ends of the central sleeve, and each provided with a through axial bore and a blind bore, an internal copper heat-shrink fitting received in said blind bore, an internal protective bushing provides inside each fitting, said bushing being longer than the copper fitting and projecting axially from each of the ends thereof, a first metal washer placed on the axially inner end of each copper fitting, said first washer having a radially outer periphery and a radially inner periphery, the radially outer periphery of said first washer being fixed to a respective steel body and the radially inner periphery being fixed to the bushing, a second metal washer placed on the axially outer end of each copper fitting, said second washer having a radially outer periphery and a radially inner periphery, the radially inner periphery of said second washer being welded on a respective bushing, while the radius of the outside periphery of said second washer being less than the outer radius of said fitting, a compressible gasket interposed between the end of each blind bore and the corresponding second metal washer, said compressible gasket being suitable for expanding radially when subjected to axial compression so as to guarantee good sealing against the axially outer end of the internal fitting, at least one through duct located axially outside the internal copper fitting of one of said two steel bodies and extending in a direction that is generally radial relative to a central axis of said roller, and a manifold provided outside said one steel body, in which opens said through duct, so as to collect cooling water flowing along said through axial bore of the roller.

13. A current-conducting roller according to claim 12, wherein the compressible gasket is made of silicone.

14. A current-conducting roller according to claim 12, wherein the compressible gasket is formed by a base ring carrying at least one annular lip.

15. A current-conducting roller according to claim 12, wherein the compressible gasket comprises a base ring provided with a first lip directed generally radially inwards and axially towards the inside of the roller, and with a second lip directed generally radially outwards and axially towards the outside of the roller.

16. A current-conducting roller according to claim 12, wherein the compressible gasket comprises a base ring which is generally complementary in shape to the bottom of the blind bore and which carries annular sealing lips.

17. A current-conducting roller according to claim 12, wherein the internal protective bushing is made of stainless steel.

18. A current-conducting roller according to claim 12, wherein each steel body is made as a single piece.

19. A current-conducting roller comprising:

a central sleeve constituting the main axial portion of the roller, two steel bodies extending on respective ends of the central sleeve, and each provided with a through axial bore, a blind second bore opening out to the axially inner end of the steel body and having a radius greater than the radius of said through axial bore, a blind third bore opening out to the axially inner end to the steel body and having a radius intermediate between the radius of the through bore and the radius of the blind second bore, an internal copper heat-shrink fitting received in said blind second bore, of each steel body, the outside radius of the internal copper fitting matching the radius of said blind second bore, an internal protective bushing provided inside each fitting, said bushing being longer than the copper fitting and projecting axially from each of the ends thereof, said internal bushing being received in said blind third bore of each steel body, the outside radius of said bushing being substantially complementary to the radius of said blind third bore and having an inside radius equal to the radius of the through axial bore, so that said bushing does not project into said through bore, a first metal washer placed on the axially inner end of each copper fitting, said first washer having a radially outer periphery and a radially inner periphery, the radially outer periphery of said first washer being fixed to a respective steel body and the radially inner periphery being fixed to the bushing, a second metal washer placed on the axially outer end of each copper fitting, said second washer having a radially outer periphery and a radially inner periphery, the radially inner periphery of said second washer being welded on a respective bushing, while the radius of the outside periphery of said second washer being less than the radius of said blind second bore, a compressible gasket interposed between the end of each blind second bore and the corresponding second metal washer, said compressible gasket being suitable for expanding radially when subjected to axial compression so as to guarantee good sealing against the axially outer end of the internal fitting.

20. A current-conducting roller according to claim 19 further comprising:

at least one through duct located axially outside the internal copper fitting of one of said two steel bodies and extending in a direction that is generally radial relative to a central axis of said roller, and a manifold provided outside said one steel body, in which opens said through duct, so s to collect cooling water flowing along said through axial bore of the roller.

21. A current-conducting roller according to claim 19, wherein the compressible gasket is made of silicone.

22. A current-conducting roller according to claim 19, wherein the compressible gasket is formed by a base ring carrying at least one annular lip.

23. A current-conducting roller according to claim 19, wherein the compressible gasket comprises a base ring provided with a first lip directed generally radially inwards and axially towards the inside of the roller, and with a second lip directed generally radially outwards and axially towards the outside of the roller.

24. A current-conducting roller according to claim 19, wherein the compressible gasket comprises a base ring which is generally complementary in shape to the bottom on the blind bore and which carries annular sealing lips.

25. A current-conducting roller according to claim 19, wherein the internal protective bushing is made of stainless steel.

26. A current-conducting roller according to claim 19, wherein each steel body is made as a single piece.

27. A current-conducting roller comprising:

a central sleeve constituting the main axial portion of the roller, two steel bodies extending on respective ends of the central sleeve each made of a single piece, and each provided with:

a through axial bore, a blind second bore opening out to the axially inner end of the steel body and having a radius greater than the radius of said through axial bore, a blind third bore opening out to the axially inner end of the steel body and having a radius intermediate between the radius of the through bore and the radius of the blind second bore, an internal copper heat-shrink fitting received in said blind second bore, of each steel body, the outside radius of the internal copper fitting matching the radius of said blind second bore, an internal protective bushing made of stainless steel, provided inside each fitting, said bushing being longer than the copper fitting and projecting axially from each of the ends thereof, said internal bushing being received in said blind third bore of each steel body, the outside radius of said bushing being substantially complementary to the radius of said blind third bore and having an inside radius equal to the radius of the through axial bore, so that said bushing does not project into said through bore, a first metal washer placed on the axially inner end of each copper fitting, said first washer having a radially outer periphery and a radially inner periphery, the radially outer periphery of said first washer being fixed to a respective steel body and the radially inner periphery being fixed to the bushing, a second metal washer placed on the axially outer end of each copper fitting, said second washer having a radially outer periphery and a radially inner periphery, the radially inner periphery of said second washer being welded on a respective bushing, while the radius of the outside periphery of said second washer being less than the radius of said blind second bore, a compressible gasket made of silicone interposed between the end of each blind second bore and the corresponding second metal washer, said compressible gasket being suitable for expanding radially when subjected to axial compression so as to guarantee good sealing against the axially outer end of the internal fitting, at least one through duct located axially outside the internal copper fitting of one of said two steel bodies and extending in a direction that is generally radial relative to a central axis of said roller, a manifold provided outside said one steel body, in which opens said through duct, so as to collect cooling water flowing along said through axial bore of the roller, and a layer of silver plating provided between the steel body and the internal copper fitting.

* * * * *